US008545346B2

(12) United States Patent
Higuchi et al.

(10) Patent No.: US 8,545,346 B2
(45) Date of Patent: Oct. 1, 2013

(54) MULTI-PIECE SOLID GOLF BALL

(75) Inventors: Hiroshi Higuchi, Chichibu (JP); Hiroyuki Nagasawa, Chichibu (JP); Junji Umezawa, Chichibu (JP); Daisuke Arai, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 614 days.

(21) Appl. No.: 12/707,886

(22) Filed: Feb. 18, 2010

(65) Prior Publication Data

US 2010/0190580 A1 Jul. 29, 2010

Related U.S. Application Data

(63) Continuation-in-part of application No. 12/361,075, filed on Jan. 28, 2009, now abandoned.

(51) Int. Cl.
*A63B 37/06* (2006.01)

(52) U.S. Cl.
USPC ..... 473/373

(58) Field of Classification Search
USPC ..... 473/373, 374, 376
See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 5,830,085 | A | 11/1998 | Higuchi et al. | |
| 6,277,035 | B1 | 8/2001 | Sullivan et al. | |
| 6,277,924 | B1 | 8/2001 | Hamada et al. | |
| 6,409,614 | B1 | 6/2002 | Binette et al. | |
| 6,561,928 | B2 | 5/2003 | Binette et al. | |
| 6,565,455 | B2 * | 5/2003 | Hayashi et al. | 473/371 |
| 6,642,314 | B2 | 11/2003 | Sone et al. | |
| 6,663,507 | B1 * | 12/2003 | Watanabe et al. | 473/373 |
| 6,712,718 | B2 | 3/2004 | Endo et al. | |
| 6,723,008 | B2 | 4/2004 | Higuchi et al. | |
| 7,160,211 | B2 | 1/2007 | Sullivan et al. | |
| 7,294,680 | B2 | 11/2007 | Sone et al. | |
| 7,563,180 | B2 | 7/2009 | Watanabe et al. | |

FOREIGN PATENT DOCUMENTS

| | | | |
|---|---|---|---|
| JP | 7-268132 | A | 10/1995 |
| JP | 11-35633 | A | 2/1999 |
| JP | 2002-85589 | A | 3/2002 |
| JP | 2002-293996 | A | 10/2002 |
| JP | 2003-199845 | A | 7/2003 |
| JP | 2004-49913 | A | 2/2004 |
| JP | 3505922 | B2 | 3/2004 |
| JP | 2005-211656 | A | 8/2005 |

(Continued)

*Primary Examiner* — Raeann Gorden
(74) *Attorney, Agent, or Firm* — Sughrue Mion, PLLC

(57) ABSTRACT

The invention provides a multi-piece solid golf ball composed of a solid core, a cover, at least one intermediate layer interposed therebetween, and a plurality of dimples on a surface of the ball. The diameter of the solid core, the deflection of the core when compressed under a final load of 130 kgf from an initial load of 10 kgf, the hardness at the center of the core, the hardness in a region 5 mm to a region 10 mm from the center of the core, the hardness in a region 15 mm from the center of the core, and the surface hardness are set within specific ranges. The intermediate layer is composed primarily of a material obtained by mixing under applied heat a specific resin composition.

8 Claims, 2 Drawing Sheets

(56) References Cited

FOREIGN PATENT DOCUMENTS

| | | | |
|---|---|---|---|
| JP | 2006-87948 | A | 4/2006 |
| JP | 3772252 | B2 | 5/2006 |
| JP | 2006-87949 | A | 6/2006 |
| WO | 98/46671 | A1 | 10/1998 |

* cited by examiner

MULTI-PIECE SOLID GOLF BALL

CROSS REFERENCE TO RELATED APPLICATION

This application is a continuation-in-part of copending application Ser. No. 12/361,075 filed on Jan. 28, 2009, the entire contents of which are hereby incorporated by reference.

BACKGROUND OF THE INVENTION

The present invention relates to a multi-piece solid golf ball of three or more layers which is composed of a solid core, an intermediate layer and a cover, and is endowed with excellent properties such as flight performance, feel on impact and controllability.

In recent years, the number of layers in solid golf balls has been increased from the conventional two-piece ball construction composed of a solid core and a cover by additionally providing an intermediate layer between the solid core and the cover, and efforts are being made to optimize each of the layers. Various three-piece golf balls have been disclosed in which a good flight performance and an excellent durability, feel and controllability are achieved by giving the core itself an optimized hardness profile and by providing the ball as a whole—including the core, the intermediate layer and the cover—with an optimized hardness profile.

For example, JP No. 3505922 (and the corresponding specification of U.S. Pat. No. 5,830,085) discloses a three-piece solid golf ball having a core, an intermediate layer and a cover, which ball satisfies the following relationship: core center hardness<core surface hardness<intermediate layer hardness<cover hardness. However, this golf ball has a low rebound.

JP No. 3772252 (and the corresponding specification of U.S. Pat. No. 6,565,455) discloses the use of the specific resin mixture mentioned in paragraph [0007] as the intermediate layer and/or cover material. Although using such an intermediate layer and/or cover material does enable a high rebound to be achieved in the golf ball, improving the durability remains a problem.

U.S. Pat. Nos. 6,409,614, 6,277,035 and 7,160,211 disclose multi-piece solid golf balls having a core, a soft inner cover and a hard outer cover, which outer cover is an ionomer cover having a high Shore D hardness. However, because the cover is too hard, these golf balls have a low spin performance on approach shots.

In the golf ball of U.S. Pat. No. 6,561,928, the total thickness of the cover encasing the core is too large, resulting in a decrease in flight performance. Other prior art includes the multi-piece solid golf ball disclosed in JP-A 2004-49913 (and the corresponding specification of U.S. Pat. No. 6,663,507).

Because the many multi-piece solid golf balls which have been disclosed to date fail to satisfy all the desired attributes—namely, flight performance, feel on impact, controllability/spin performance and durability, a need has been felt for further improvement.

SUMMARY OF THE INVENTION

It is therefore an object of the present invention to provide a multi-piece golf ball of at least three layers which has a solid core, an intermediate layer and a cover, and which is endowed with an excellent feel on impact, controllability and flight performance.

The inventors have conducted extensive investigations in order to achieve the above object. As a result, they have discovered that, in a multi-piece solid golf ball having a core, an intermediate layer and a cover, by optimizing the core hardness profile and by optimizing also the relationship between the intermediate layer, cover and core surface hardnesses, the ball can be imparted with an excellent feel on impact and an excellent spin performance on approach shots, in addition to which the ball can be conferred with a low spin rate on full shots, enabling an improved distance to be achieved. Moreover, the inventors have found that blending, in the intermediate layer, a highly neutralized ionomer and a thermoplastic block polymer (such as one having the trade name "Dynaron") enables the ball rebound and durability precision to be further enhanced, imparting an excellent performance in both respects. The inventors have also found that by improving the melt flow rate (MFR), molding can be carried out at a good productivity even when the cover is thin.

Accordingly, the invention provides the following multi-piece solid golf balls.

[1] A multi-piece solid golf ball comprising a solid core, a cover, at least one intermediate layer interposed therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to a region 10 mm from the core center of from 23 to 41, a Shore D hardness in a region 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random terpolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer having a crystalline polyolefin block and a polyethylene/butylene random copolymer, with (d) from 5 to 100 parts by weight of a fatty acid or fatty acid derivative having a molecular weight of from 280 to 1500, and (e) from 0.1 to 10 parts by weight of a basic inorganic metal compound capable of neutralizing acid groups within components (a), (b) and (d);

the intermediate layer has a thickness of from 1.5 to 2.5 mm; the intermediate layer material has a Shore D hardness of from 35 to 55 and a melt flow rate (MFR) of from 9 to 30 g/10 min; the intermediate layer has a Shore D hardness difference with the surface of the solid core of within ±10; the cover is composed primarily of a thermoplastic resin, has a thickness of from 0.5 to 1.5 mm, and has a Shore D hardness of from 50 to 59 which is higher than the intermediate layer hardness, the Shore D hardness difference therebetween being from 1 to 15; the cover has a material melt flow rate (MFR) of from 2 to 30 g/10 min; the cover and the intermediate layer have a combined thickness of from 2 to 3.5 mm; the overall ball has a deflection, when compressed under a final load of 130 kgf from an initial load of 10 kgf, of from 2.9 to 5.0 mm; the number of dimples is from 250 to 400; and the sum of the dimple trajectory volumes VT (total dimple trajectory volume TVT) obtained by multiplying the volume of each dimple by the square root of the dimple diameter is from 640 to 800.

[2] The multi-piece solid golf ball of [1], wherein the thermoplastic resin of the cover is a thermoplastic ionomer.

BRIEF DESCRIPTION OF THE DIAGRAMS

DETAILED DESCRIPTION OF THE INVENTION

Figure 1:
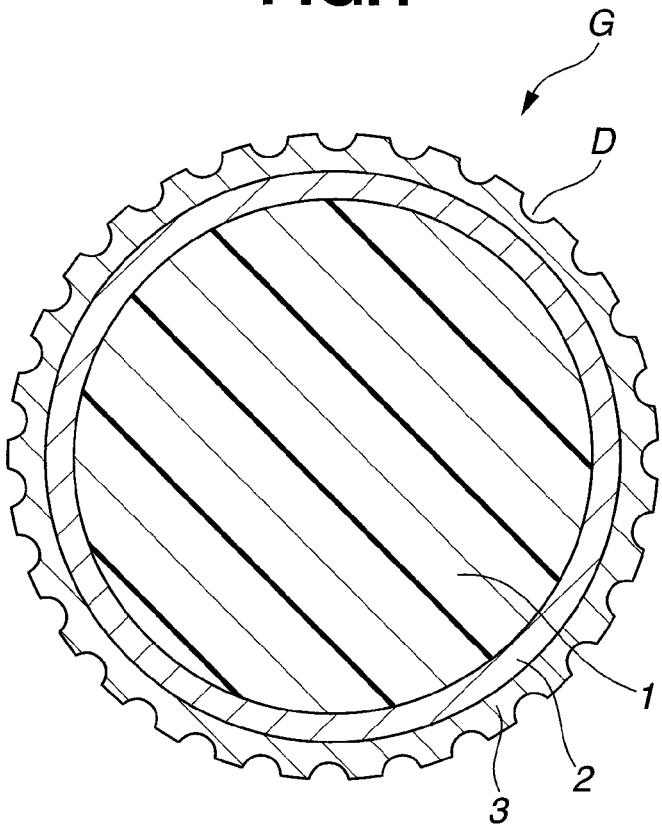
FIG. 1 is a cross-sectional view showing a multi-piece solid golf ball according to one embodiment of the invention.

Describing the invention more fully below in conjunction with the attached diagrams, the multi-piece golf ball of the invention has at least a three-piece construction composed of a solid core 1, an intermediate layer 2 encasing the solid core 1, and a cover 3 encasing the intermediate layer 2. A plurality of dimples D are formed on the surface of the cover 3. FIG. 1 shows a construction in which the solid core 1, the intermediate layer 2, and the cover 3 are composed of one layer each, although these may have multilayer constructions of two or more layers. If necessary, the solid core 1, the intermediate layer 2 and the cover 3 may each have a multilayer construction. When the solid core, intermediate layer or cover described below has a multilayer construction, the multiple layers together should be configured in such a way as to collectively satisfy the conditions which pertain to that piece of the golf ball.

First, the solid core is described. The solid core is molded under the application of heat from a rubber composition containing polybutadiene as the base rubber.

Here, the polybutadiene has a cis-1,4 bond content of at least 60%, preferably at least 80%, more preferably at least 90%, and most preferably at least 95%.

It is recommended that the polybutadiene have a Mooney viscosity ($ML_{1+4}$ (100° C.)) of at least 30, preferably at least 35, more preferably at least 40, even more preferably at least 50, and most preferably at least 52, but not more than 100, preferably not more than 80, more preferably not more than 70, and most preferably not more than 60.

The term "Mooney viscosity" used herein refers to an industrial indicator of viscosity as measured with a Mooney viscometer, which is a type of rotary plastometer (JIS-K6300).

The unit symbol used is $ML_{1+4}$ (100° C.), where "M" stands for Mooney viscosity, "L" stands for large rotor (L-type), "1+4" denotes a pre-heating time of 1 minute and a rotor rotation time of 4 minutes, and "100° C." indicates that measurement was carried out at a temperature of 100° C.

The molecular weight distribution Mw/Mn (where Mw stands for the weight-average molecular weight, and Mn stands for the number-average molecular weight) of the above polybutadiene is at least 2.0, preferably at least 2.2, more preferably at least 2.4, and even more preferably at least 2.6, but not more than 6.0, preferably not more than 5.0, more preferably not more than 4.0, and even more preferably not more than 3.4. If Mw/Mn is too small, the workability may worsen. On the other hand, if it is too large, the rebound may decrease.

The polybutadiene may be synthesized using a nickel or cobalt catalyst, or may be synthesized using a rare-earth catalyst. Synthesis with a rare-earth catalyst is especially preferred. A known rare-earth catalyst may be used for this purpose.

Examples include catalysts obtained by combining a lanthanum series rare-earth compound, an organoaluminum compound, an alumoxane, a halogen-bearing compound and, if necessary, a Lewis base.

In the present invention, the use of a neodymium catalyst containing a neodymium compound as the lanthanum series rare-earth compound is advantageous because it enables a polybutadiene rubber having a high 1,4-cis bond content and a low 1,2-vinyl bond content to be obtained at an excellent polymerization activity. Preferred examples of such rare-earth catalysts include those mentioned in JP-A 11-35633.

When butadiene is polymerized in the presence of a rare-earth catalyst, bulk polymerization or vapor-phase polymerization may be carried out, with or without the use of a solvent. The polymerization temperature may be set to generally between −30° C. and 150° C., and preferably between 10 and 100° C.

Alternatively, the polybutadiene may be obtained by polymerization using the rare-earth catalyst, followed by the reaction of an active end on the polymer with a terminal modifier.

Examples of terminal modifiers and methods for carrying out such a reaction includes those described in, for example, JP-A 11-35633, JP-A 7-268132 and JP-A 2002-293996.

The polybutadiene should be included in the rubber base in an amount of at least 60 wt %, preferably at least 70 wt %, more preferably at least 80 wt %, and most preferably at least 90 wt %. The upper limit in the amount of polybutadiene included is 100 wt % or less, preferably 98 wt % or less, and more preferably 95 wt % or less. When too little polybutadiene is included in the rubber base, it is difficult to obtain a golf ball having a good rebound.

Rubbers other than the above-described polybutadiene may be included and used together with the polybutadiene insofar as the objects of the invention are attainable. Illustrative examples include polybutadiene rubbers (BR), styrene-butadiene rubbers (SBR), natural rubbers, polyisoprene rubbers, and ethylene-propylene-diene rubbers (EPDM). These may be used singly or as combinations of two or more thereof.

The hot-molded solid core is formed using a rubber composition prepared by blending, as essential ingredients, specific amounts of an unsaturated carboxylic acid or a metal salt thereof, an organosulfur compound, an inorganic filler and an antioxidant with 100 parts by weight of the above-described base rubber.

The unsaturated carboxylic acid is exemplified by acrylic acid, methacrylic acid, maleic acid and fumaric acid. Acrylic acid and methacrylic acid are especially preferred.

Metal salts of unsaturated carboxylic acids that may be used include the zinc and magnesium salts of unsaturated fatty acids, such as zinc methacrylate and zinc acrylate. The use of zinc acrylate is especially preferred.

The amount of unsaturated carboxylic acid and/or metal salt thereof included per 100 parts by weight of the base rubber is preferably at least 20 parts by weight, more preferably at least 22 parts by weight, even more preferably at least 24 parts by weight, and most preferably at least 26 parts by weight, but preferably not more than 45 parts by weight, more preferably not more than 40 parts by weight, even more preferably not more than 35 parts by weight, and most preferably not more than 30 parts by weight. Including too much will result in excessive hardness, giving the ball an unpleasant feel when played. On the other hand, including too little will result in a decrease in the rebound.

An organosulfur compound may optionally be included. The organosulfur compound can be advantageously used to impart an excellent rebound. Thiophenols, thionaphthols, halogenated thiophenols, and metal salts thereof are recommended for this purpose. Illustrative examples include pentachlorothiophenol, pentafluorothiophenol, pentabromothiophenol, p-chlorothiophenol, and the zinc salt of pentachlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

The amount of the organosulfur compound included per 100 parts by weight of the base rubber is preferably at least 0 part by weight, more preferably at least 0.1 part by weight, even more preferably at least 0.2 part by weight, and most preferably at least 0.4 part by weight, but preferably not more than 5 parts by weight, more preferably not more than 4 parts by weight, even more preferably not more than 3 parts by weight, and most preferably not more than 2 parts by weight. Including too much organosulfur compound may excessively lower the hardness, whereas including too little is unlikely to improve the rebound.

The inorganic filler is exemplified by zinc oxide, barium sulfate and calcium carbonate. The amount of the inorganic filler included per 100 parts by weight of the base rubber is preferably at least 5 parts by weight, more preferably at least 6 parts by weight, even more preferably at least 7 parts by weight, and most preferably at least 8 parts by weight, but preferably not more than 80 parts by weight, more preferably not more than 60 parts by weight, even more preferably not more than 40 parts by weight, and most preferably not more than 20 parts by weight. Too much or too little inorganic filler may make it impossible to achieve a suitable weight and a good rebound.

The organic peroxide may be a commercial product, examples of which include those available under the trade names Percumyl D (produced by NOF Corporation), Perhexa 3M (NOF Corporation), Perhexa C (NOF Corporation, and Luperco 231XL (Atochem Co.). The use of Perhexa 3M or Perhexa C is preferred.

A single organic peroxide may be used alone or two or more different organic peroxides may be mixed and used together. Mixing two or more different organic peroxides is preferred from the standpoint of further enhancing rebound.

The amount of the organic peroxide included per 100 parts of the base rubber is preferably at least 0.1 part by weight, more preferably at least 0.2 part by weight, and even more preferably at least 0.3 part by weight, but preferably not more than 2 parts by weight, more preferably not more than 1.5 parts by weight, and even more preferably not more than 1 part by weight. Including too much or too little organic peroxide may prevent the desired hardness profile from being achieved, making it impossible, in turn, to achieve the desired feel on impact, durability and rebound.

In the present invention, an antioxidant may be included if necessary. Illustrative examples of the antioxidant include commercial products such as Nocrac NS-6 and Nocrac NS-30 (both produced by Ouchi Shinko Chemical Industry Co., Ltd.), and Yoshinox 425 (Yoshitomi Pharmaceutical Industries, Ltd.).

To achieve a good rebound and durability, it is recommended that the amount of the antioxidant included per 100 parts by weight of the base rubber be preferably at least 0 part by weight, more preferably at least 0.03 part by weight, and even more preferably at least 0.05 part by weight, but preferably not more than 0.4 part by weight, more preferably not more than 0.3 part by weight, and even more preferably not more than 0.2 part by weight.

Sulfur may also be added if necessary. Such sulfur is exemplified by the product manufactured by Tsurumi Chemical Industry Co., Ltd. under the trade name "Sulfur Z." The amount of sulfur included per 100 parts by weight of the base rubber is preferably at least 0 part by weight, more preferably at least 0.05 part by weight, and more preferably at least 0.01 part by weight, but preferably not more than 0.5 part by weight, more preferably not more than 0.4 part by weight, and even more preferably not more than 0.1 part by weight. By adding sulfur, the core hardness profile can be increased. Adding too much sulfur may result in undesirable effects during hot molding, such as explosion of the rubber composition, or may considerably lower the rebound.

To achieve the subsequently described specific core hardness profile and core deflection, the foregoing rubber composition is suitably selected and fabrication of the solid core (hot-molded piece) is carried out by vulcanization and curing according to a method similar to that used for conventional golf ball rubber compositions. Suitable vulcanization conditions include, for example, a vulcanization temperature of between 100° C. and 200° C., and a vulcanization time of between 10 and 40 minutes. To obtain the desired rubber crosslinked body for use as the core in the present invention, the vulcanizing temperature is preferably at least 150° C., and especially at least 155° C., but preferably not above 200° C., more preferably not above 190° C., even more preferably not above 180° C., and most preferably not above 170° C.

It is critical for the solid core of the invention to have a diameter between 34.0 and 38.7 mm. It is recommended that the solid core have a diameter of preferably at least 34.5 mm, more preferably at least 35.0 mm, even more preferably at least 35.5 mm, and most preferably at least 36.0 mm, but preferably not more than 38.2 mm, more preferably not more than 37.7 mm, even more preferably not more than 37.0 mm, and most preferably not more than 36.5 mm. At too small a diameter, the soft core becomes smaller, which may lower the ball rebound and result in a harder feel when the ball is played. On the other hand, at too large a diameter, the intermediate layer and cover necessarily become thinner, which may result in a poor durability.

The solid core has a center hardness, expressed as the Shore D hardness, of at least 20, preferably at least 25, more preferably at least 30, and even more preferably at least 33, but not more than 38, preferably not more than 37, even more preferably not more than 36, and most preferably not more than 35.

The solid core has a hardness in the region 5 mm to the region 10 mm from the center thereof, expressed as the Shore D hardness, of at least 23, preferably at least 28, more preferably at least 32, and even more preferably at least 35, but not more than 41, preferably not more than 40, even more preferably not more than 39, and most preferably not more than 38.

The region of the solid core 15 mm from the center has a hardness, expressed as the Shore D hardness, of at least 28, preferably at least 33, more preferably at least 36, and even more preferably at least 39, but not more than 46, preferably not more than 45, and even more preferably not more than 44.

The surface of the solid core has a hardness, expressed as the Shore D hardness, of at least 37, preferably at least 39, more preferably at least 41, and even more preferably at least 42, but not more than 62, preferably not more than 57, even more preferably not more than 52, and most preferably not more than 48.

The hardness difference between the surface and center of the solid core as expressed in Shore D hardness units, while not subject to any particular limitation, is preferably at least 5, and more preferably at least 6, but preferably not more than 30, more preferably not more than 25, and even more preferably not more than 20. At a hardness difference smaller than the above range, the spin rate on shots with a driver may rise, lowering the distance traveled by the ball. On the other hand, at a hardness difference larger than the above range, the rebound and durability of the ball may decrease.

The solid core has a deflection, when compressed under a final load of 130 kgf from an initial load of 10 kgf, of at least 3.5 mm, preferably at least 3.8 mm, and more preferably at least 4.1 mm, but not more than 6.0 mm, preferably not more than 5.5 mm, more preferably not more than 5.0 mm, and most preferably not more than 4.8 mm. Too small a deflection by the solid core may worsen the feel of the ball on impact and, particularly on long shots such as with a driver in which the ball incurs a large deformation, may subject the ball to an excessive rise in the spin rate, shortening the distance traveled by the ball. On the other hand, a solid core which is too soft may deaden the feel of the ball when played and result in a less than adequate rebound, shortening the distance traveled by the ball, and moreover may give the ball a poor durability to cracking on repeated impact.

Next, in the present invention, the intermediate layer material includes, as the base resin, a resin component of:

(a) from 95 to 50 wt % of an olefin-unsaturated carboxylic acid-unsaturated carboxylic acid ester random terpolymer and/or a metal salt thereof, (b) from 0 to 20 wt % of an olefin-unsaturated carboxylic acid random copolymer and/or a metal salt thereof, and (c) from 5 to 50 wt % of a thermoplastic block copolymer having crystalline polyolefin blocks and a polyethylene/butylene random copolymer.

The olefin-unsaturated carboxylic acid-unsaturated carboxylic acid ester random terpolymer and/or a metal salt thereof serving as component (a) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably from 3.0 to 7.0.

Above component (a) is an olefin-containing copolymer. The olefin in component (a) is exemplified by olefins in which the number of carbons is at least 2 but not more than 8, and preferably not more than 6. Illustrative examples of such olefins include ethylene, propylene, butene, pentene, hexene, heptene and octene. The use of ethylene is especially preferred.

Illustrative examples of the unsaturated carboxylic acid in component (a) include acrylic acid, methacrylic acid, maleic acid and fumaric acid. Acrylic acid and methacrylic acid are especially preferred.

The unsaturated carboxylic acid ester in component (a) may be, for example, a lower alkyl ester of an unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. The use of butyl acrylate (n-butyl acrylate, isobutyl acrylate) is especially preferred.

The random copolymer serving as component (a) in the invention may be obtained by the random copolymerization of the above ingredients in accordance with a known method. It is recommended here that the unsaturated carboxylic acid content (acid content) within the random copolymer be generally at least 2 wt %, preferably at least 6 wt %, and more preferably at least 8 wt %, but not more than 25 wt %, preferably not more than 20 wt %, and more preferably not more than 15 wt %. At a low acid content, the rebound may decrease, whereas at a high acid content, the material processability may decrease.

The copolymer of component (a) accounts for a proportion of the overall base resin which is from 95 to 50 wt %, preferably at least 60 wt %, more preferably at least 70 wt %, and even more preferably at least 75 wt %, but preferably not more than 92 wt %, more preferably not more than 89 wt %, and even more preferably not more than 86 wt %.

The metal salt of the copolymer of component (a) may be obtained by neutralizing some of the acid groups in the random copolymer of component (a) with metal ions.

Examples of the metal ions which neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, $Na^+$, $Li^+$, $Zn^{++}$, $Mg^{++}$ or $Ca^{++}$ are preferred, and $Zn^{++}$ is especially preferred. The degree of neutralization of the random copolymer by these metal ions, while not subject to any particular limitation, is generally at least 5 mol %, preferably at least 10 mol %, and especially at least 20 mol %, but not more than 95 mol %, preferably not more than 90 mol %, and especially not more than 80 mol %. At a degree of neutralization in excess of 95 mol %, the moldability may decrease. On the other hand, at less than 5 mol %, there arises a need to increase the amount in which the inorganic metal compound serving as component (c) is added, which may present a drawback in terms of cost. Such a neutralization product may be obtained by a known method. For example, the neutralization product may be obtained by introducing a metal ion compound, such as a formate, acetate, nitrate, carbonate, bicarbonate, oxide, hydroxide or alkoxide, into the random copolymer.

Illustrative examples of the olefin-unsaturated carboxylic acid-unsaturated carboxylic acid ester random terpolymer serving as component (a) include those available under the trade names Nucrel AN4318, Nucrel AN4319, and Nucrel AN4311 (DuPont-Mitsui Polychemicals Co., Ltd.). Illustrative examples of the metal salts of olefin-unsaturated carboxylic acid-unsaturated carboxylic acid ester random terpolymer include those available under the trade names Himilan AM7316, Himilan AM7331, Himilan 1855 and Himilan 1856 (DuPont-Mitsui Polychemicals Co., Ltd.), and those available under the trade names Surlyn 6320 and Surlyn 8120 (E.I. DuPont de Nemours and Co., Ltd.).

The olefin-unsaturated carboxylic acid random copolymer and/or metal salt serving as component (b) has a weight-average molecular weight (Mw) of preferably at least 100,000, more preferably at least 110,000, and even more preferably at least 120,000, but preferably not more than 200,000, more preferably not more than 190,000, and even more preferably not more than 170,000. The weight-average molecular weight (Mw) to number-average molecular weight (Mn) ratio for the copolymer is preferably from 3.0 to 7.0.

The copolymer of component (b) accounts for a proportion of the overall base resin which is from 0 to 20 wt %, preferably at least 1 wt %, but preferably not more than 17 wt %, more preferably not more than 10 wt %, even more preferably not more than 8 wt %, and most preferably not more than 5 wt %.

Illustrative examples of the olefin-unsaturated carboxylic acid random copolymer serving as component (b) include those available under the trade names Nucrel 1560, Nucrel 1525 and Nucrel 1035 (DuPont-Mitsui Polychemicals Co., Ltd.). Illustrative examples of the metal salts of olefin-unsaturated carboxylic acid random copolymer include those available under the trade names Himilan 1605, Himilan 1601, Himilan 1557, Himilan 1705 and Himilan 1706 (DuPont-Mitsui Polychemicals Co., Ltd.) and those available under the trade names Surlyn 7930 and Surlyn 7920 (E.I. DuPont de Nemours and Co., Ltd.).

The thermoplastic block copolymer having a crystalline polyolefin block and a polyethylene/butylene random copolymer which serves as component (c) is exemplified by thermoplastic block copolymers composed of crystalline polyethylene blocks (E) as hard segments and blocks of a relatively random copolymer of ethylene and butylene (EB) as soft segments. Preferred use may be made of block copolymers having a molecular structure with a hard segment at one or both ends, such as block copolymers having an E-EB or E-EB-E structure.

Such thermoplastic block copolymers having a crystalline polyolefin block and a polyethylene/butylene random copolymer which serve as component (c) may be obtained by hydrogenating polybutadiene.

A polybutadiene in which bonding within the butadiene structure is characterized by the presence of a block-like 1,4-polymer region having a 1,4-bond content of from 95 to 100 wt %, and in which the butadiene structure as a whole has a 1,4-bond content of from 50 to 100 wt %, and preferably from 80 to 100 wt %, may be suitably used here as the polybutadiene subjected to hydrogenation. That is, preferred use may be made of a polybutadiene having a 1,4-bond content of 50 to 100 wt %, and preferably 80 to 100 wt %, and having a block-like 1,4-polymer region with a 1,4-bond content of 95 to 100 wt %.

The above-mentioned E-EB-E type thermoplastic block copolymer is preferably one obtained by hydrogenating a polybutadiene having at both ends of the molecular chain 1,4-polymerization products which are rich in 1,4-bonds and having an intermediate region where 1,4-bonds and 1,2-bonds are intermingled. The degree of hydrogenation (conversion of double bonds on the polybutadiene to saturated bonds) in the polybutadiene hydrogenate is preferably from 60 to 100%, and more preferably from 90 to 100%. Too low a degree of hydrogenation may give rise to undesirable effects such as gelation in the blending step with other components such as an ionomer resin and, when the golf ball is formed, may lead to problems associated with the intermediate layer, such as a poor durability to impact.

In the block copolymer having a E-EB or E-EB-E molecular structure with a hard segment at one or both ends that may be preferably used as the thermoplastic block copolymer, the content of the hard segments is preferably from 10 to 50 wt %. If the content of hard segments is too high, the intermediate layer may lack sufficient softness, making it difficult to effectively achieve the objects of the invention. On the other hand, if the content of hard segments is too low, the blend may have a poor moldability.

The thermoplastic block copolymer has a melt index, at 230° C. and a test load of 21.2 N, of preferably from 0.01 to 15 g/10 min, and more preferably from 0.03 to 10 g/10 min. Outside of this range, problems such as weld lines, sink marks and short shots may arise during injection molding.

Moreover, the thermoplastic block copolymer preferably has a surface hardness of from 10 to 50. If the surface hardness is too low, the golf ball may have a decreased durability to repeated impact. On the other hand, if the surface hardness is too high, blends of the thermoplastic block with an ionomer resin may have a decreased rebound.

The thermoplastic block copolymer has a number-average molecular weight of preferably between 30,000 and 800,000.

Commercial products may be used as the above-described thermoplastic block copolymer having a crystalline polyolefin block and a polyethylene/butylene random copolymer. Illustrative examples include Dynaron 6100P, Dynaron 6200P and Dynaron 6201B available from JSR Corporation. Dynaron 6100P, which is a block polymer having crystalline olefin blocks at both ends, is especially preferred for use in the present invention. These olefin thermoplastic elastomers may be used singly or as mixtures of two or more thereof.

The proportion of the overall base resin accounted for by the copolymer serving as component (c) is from 5 to 50 wt %, preferably at least 8 wt %, more preferably at least 11 wt %, and even more preferably at least 14 wt %, but preferably not more than 40 wt %, more preferably not more than 30 wt %, and even more preferably not more than 20 wt %.

The intermediate layer material also includes, mixed therein per 100 parts by weight of above resin components (a) to (c):

(d) from 5 to 100 parts by weight of a fatty acid or fatty acid derivative having a molecular weight of from 280 to 1500; and (e) from 0.1 to 10 parts by weight of a basic inorganic metal compound capable of neutralizing acid groups within components (a), (b) and (d).

Component (d) is a fatty acid or fatty acid derivative having a molecular weight of at least 280 but not more than 1500 whose purpose is to enhance the flow properties of the heated mixture. It has a molecular weight which is much smaller than those of components (a) to (c), and helps to significantly decrease the melt viscosity of the mixture. Also, because the fatty acid (or fatty acid derivative) of component (d) has a molecular weight of at least 280 but not more than 1500 and has a high content of acid groups (or derivative moieties thereof), its addition to the resin material results in little if any loss of rebound.

The fatty acid or fatty acid derivative serving as component (d) may be an unsaturated fatty acid or fatty acid derivative having a double bond or triple bond in the alkyl moiety, or it may be a saturated fatty acid or fatty acid derivative in which all the bonds in the alkyl moiety are single bonds. It is recommended that the number of carbon atoms on the molecule be preferably at least 18, but preferably not more than 80, and more preferably not more than 40. Too few carbons may result in a poor heat resistance, and may also set the acid group content so high as to cause the acid groups to interact with acid groups present on the base resin, diminishing the flow-improving effects. On the other hand, too many carbons increases the molecular weight, which may significantly lower the flow properties, and make the material difficult to use.

Specific examples of fatty acids that may be used as component (d) include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid and lignoceric acid.

The fatty acid derivative of component (d) is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}$, $Ca^{++}$, $Mg^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (d) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

In the present invention, the amount of component (d) used per 100 parts by weight of the base resin is at least 5 parts by weight, preferably at least 8 parts by weight, more preferably at least 20 parts by weight, and even more preferably at least 40 parts by weight, but not more than 100 parts by weight, preferably not more than 90 parts by weight, even more preferably not more than 80 parts by weight, and most preferably not more than 70 parts by weight.

Use may also be made of known metallic soap-modified ionomers (see, for example, U.S. Pat. No. 5,312,857, U.S. Pat. No. 5,306,760 and International Disclosure WO 98/46671) when using above components (a) and (b).

Component (e) is a basic inorganic metal compound capable of neutralizing the acid groups in above components (a), (b) and (d). As mentioned in prior-art examples, when components (a), (b) and (d) alone, and in particular a metal-modified ionomer resin alone (e.g., a metal soap-modified ionomer resin of the type mentioned in the foregoing patent publications, alone), are heated and mixed, as shown below, the metallic soap and un-neutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion. Component (e) is included so as to resolve such problems.

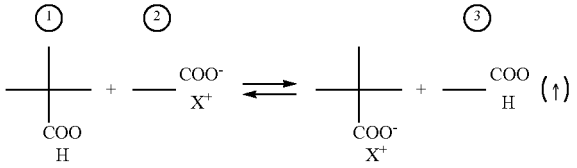

(1) un-neutralized acid group present on the ionomer resin
(2) metallic soap
(3) fatty acid
X: metal atom The heated mixture used in the present invention thus includes, as component (e), a basic inorganic metal compound which neutralizes the acid groups present in above components (a), (b) and (d). The inclusion of component (e) as an essential ingredient confers excellent properties. That is, the acid groups in above components (a), (b) and (d) are neutralized, and synergistic effects from the inclusion of each of these components increase the thermal stability of the heated mixture while at the same time conferring a good moldability and enhancing the rebound of the golf ball.

It is recommended that above component (e) be a basic inorganic metal compound—preferably a monoxide or hydroxide—which is capable of neutralizing acid groups in above components (a), (b) and (d). Because such compounds have a high reactivity with the ionomer resin and the reaction by-products contain no organic matter, the degree of neutralization of the heated mixture can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide or hydroxide is preferred. The use of magnesium oxide or calcium hydroxide, which have high reactivities with ionomer resins, is especially preferred.

Component (e) of the present invention is included in an amount, per 100 parts by weight of the base resin, of from 0.1 to 10 parts by weight, preferably at least 0.5 part by weight, more preferably at least 1 part by weight, but preferably not more than 5 parts by weight, more preferably not more than 3 parts by weight, and even more preferably not more than 2 parts by weight.

The heated mixture used in the present invention, which includes, as described above, components (a) to (e), can be provided with improved thermal stability, moldability and resilience. To this end, it is recommended that, in all heated mixtures used in the invention, at least 70 mol %, preferably at least 80 mol %, and more preferably at least 90 mol %, of the acid groups in the mixture be neutralized. A high degree of neutralization more reliably suppresses the exchange reactions that pose a problem in the above-described cases where components (a) and (b) and the fatty acid (or fatty acid derivative) alone are used, thus making it possible to prevent the generation of fatty acids. As a result, a material can be obtained which has a markedly increased thermal stability, a good moldability, and a substantially higher resilience than conventional ionomer resins.

Here, with regard to neutralization of the heated mixture of the invention, to more reliably achieve both a high degree of neutralization and good flow properties, it is recommended that the acid groups in the heated mixture be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the heated mixture and thus enable the flow properties to be significantly improved.

In the present invention, various additives may also be optionally included in the above heated mixture. Additives which may be used include pigments, dispersants, antioxidants, ultraviolet absorbers and optical stabilizers. Moreover, to improve the feel of the golf ball on impact, the resin composition may also include, in addition to the above essential ingredients, various non-ionomeric thermoplastic elastomers. Illustrative examples of such non-ionomeric thermoplastic elastomers include styrene-based thermoplastic elastomers, ester-based thermoplastic elastomers and urethane-based thermoplastic elastomers. The use of styrene-based thermoplastic elastomers is especially preferred.

The method of preparing the heated mixture is exemplified by mixture under heating at a temperature of between 150 and 250° C. in an internal mixer such as a twin-screw extruder, a Banbury mixer or a kneader. The method of forming the intermediate layer using the heated mixture is not subject to any particular limitation. For example, the intermediate layer may be formed by injection molding or compression molding the heated mixture. When injection molding is employed, the process may involve placing a prefabricated solid core at a given position in the injection mold, then introducing the above-described material into the mold. When compression molding is employed, the process may involve producing a pair of half cups from the above-described material, covering the core with these half-cups, either directly or with an intervening intermediate layer, then applying pressure and heat within a mold. If molding under heat and pressure is carried out, the molding conditions may be a temperature of from 120 to 170° C. and a period of from 1 to 5 minutes.

In the invention, the intermediate layer material has a Shore D hardness in a range of 35 to 55, preferably at least 40, more preferably at least 43, and even more preferably at least 45, but preferably not more than 55, more preferably not more than 53, even more preferably not more than 51, and most preferably not more than 50. If the Shore D hardness is low, the rebound may decrease, resulting in a shorter distance.

The intermediate layer is formed to a thickness of at least 1.5 mm, preferably at least 1.7 mm, more preferably at least 1.8, and even more preferably at least 1.9 mm, but not more than 2.5 mm, preferably not more than 2.3 mm, even more preferably not more than 2.2 mm, and most preferably not more than 2.1 mm. If the intermediate layer is too thick, it will not be possible to enhance the feel and the distance and flight performance of the ball. On the other hand, if the intermediate layer is too thin, the distance and flight performance and the durability will worsen.

It is essential that the intermediate layer material have a melt flow rate (measured in accordance with JIS-K6760 (test temperature, 190° C.; test load, 21 N (2.16 kgf)) of from 9 to 30 g/10 min, preferably at least 10 g/10 min, more preferably at least 11 g/10 min, and even more preferably at least 12 g/10 min, but preferably not more than 25 g/10 min, more preferably not more than 21 g/10 min, and even more preferably not more than 18 g/10 min. If the melt index of the heated mixture is low, the processability of the mixture may markedly decrease.

Also, in the present invention, it is critical that the Shore D hardness of the intermediate layer minus the Shore D hardness of the solid core surface be within ±10, the upper limit being preferably 8 or less, more preferably 7 or less, and even more preferably 6 or less, and the lower limit being at least −7, more preferably at least −4, and even more preferably at least −1. When this hardness difference is above 10, the intermediate layer is too hard and the core is too soft, detracting from the feel of the ball and lowering the rebound and durability. On the other hand, when the hardness difference is below −10, the intermediate layer is too soft and the core is too hard, detracting from the feel of the ball on impact and lowering the ball rebound.

Next, the cover used in the present invention is described.

In the present invention, a thermoplastic resin material is used as the cover material. The thermoplastic resin is not subject to any particular limitation. However, from the standpoint of comprehensively achieving the effects of the invention, the cover material is preferably a thermoplastic ionomer. Thermoplastic ionomers that may be employed include commercially available ionomers, and also the ionomeric compositions described above in connection with the intermediate layer material.

Next, the cover of the inventive golf ball is formed to a relatively small thickness of from 0.5 to 1.5 mm. The cover thickness is preferably at least 0.7 mm, more preferably at least 0.9 mm, even more preferably at least 1.1 mm, and most preferably at least 1.2 mm, but preferably not more than 1.45 mm, more preferably not more than 1.4 mm, and even more preferably not more than 1.35 mm. If the cover is thinner than the above range, the durability will worsen, the scuff resistance will worsen, or the cover will become more susceptible to cracking. If the cover is thicker than the above range, the feel on impact will worsen or the ball will not travel as far.

The cover material used in the invention has a Shore D hardness of from 50 to 59, preferably at least 52, more preferably at least 54, and even more preferably at least 55, but preferably not more than 59, more preferably not more than 58, and even more preferably not more than 57. At a Shore D hardness which is too low, the rebound and the distance will decrease. On the other hand, at a Shore D hardness which is too high, the ball will have too hard a feel. It is possible in this way for the cover to have a lower Shore D hardness than in conventional golf balls, thus enabling a further increase in controllability to be achieved without a loss in rebound.

The cover hardness is higher than the intermediate layer hardness, the Shore D hardness difference therebetween being from 1 to 15, preferably at least 3, more preferably at least 5, and even more preferably at least 7, but preferably not more than 13, more preferably not more than 12, and even more preferably not more than 11. Outside of the above hardness difference range, the durability to cracking may worsen or the feel on impact may worsen.

It is critical for the cover material to have a melt flow rate (MFR) of from 2 to 30 g/10 min, preferably at least 3 g/10 min, more preferably at least 4 g/10 min, and even more preferably at least 5 g/10 min, but preferably not more than 30 g/10 min, more preferably not ore than 25 g/10 min, even more preferably not more than 20 g/10 min, and most preferably not more than 15 g/10 min. At a small melt index for the heated mixture, the processability markedly decreases, which may make it impossible to achieve a good sphericity when the cover is thin.

It is essential for the cover and the intermediate layer to have a combined thickness of from 2 to 3.5 mm. If this combined thickness is too large, the feel of the ball will worsen and the distance traveled by the ball will decrease. On the other hand, if the combined thickness is too small, the durability of the ball will decrease. The combined thickness is preferably at least 2.3 mm, more preferably at least 2.6 mm, and even more preferably at least 2.9 mm, but preferably not more than 3.4 mm, and more preferably not more than 3.3 mm.

The golf ball diameter should accord with golf ball standards, and is preferably not less than 42.67 mm, and preferably not more than 44 mm, more preferably not more than 43.8 mm, even more preferably not more than 43.5 mm, and most preferably not more than 43 mm. In the above range in the golf ball diameter, the deflection of the ball as a whole when compressed under a final load of 130 kgf from an initial load of 10 kgf (which deflection is also called the "product hardness") must be from 2.9 to 5.0 mm. The product hardness is preferably at least 3.0 mm, more preferably at least 3.1 mm, and even more preferably at least 3.2 mm, but preferably not more than 4.5 mm, more preferably not more than 4.0 mm, and even more preferably not more than 3.9 mm.

To increase the aerodynamic performance and extend the distance traveled by the ball, the number of dimples formed on the ball surface is from 250 to 400, preferably at least 270, more preferably at least 290, and even more preferably at least 300, but preferably not more than 380, more preferably not more than 360, and even more preferably not more than 340.

The sum of the dimple trajectory volumes VT (total dimple trajectory volume TVT) obtained by multiplying the volume V of each dimple by the square root of the dimple diameter $D_i$ must be from 640 to 800, and is preferably at least 645, more preferably at least 650, and even more preferably at least 655, but preferably not more than 770, more preferably not more than 740, and even more preferably not more than 710. In the present invention, TVT is the sum of the VT ($=V\times D_i^{0.5}$) for each dimple. Here, the dimple volume V, although not shown in the diagrams, is the volume of the recessed region circumscribed by the edge of a dimple. The approximate trajectory height at high head speeds, particularly at head speeds of about 45 m/s to about 55 m/s, can be determined from this TVT value. Generally, the angle of elevation is large at a small TVT value, and is small at a large TVT value. In the present invention, as noted above, the TVT value is set in a range of from 640 to 800. At too small a TVT value, the trajectory will be too high, resulting in an insufficient run and thereby shortening the total distance. On the other hand, at too large a TVT value, the trajectory will be too low, resulting in an insufficient carry and likewise shortening the distance. Moreover, outside the TVT range of the invention, the ball will have a large variability in the carry, lowering the stability of the ball performance in all such cases.

As explained above, the multi-piece solid golf ball of the invention, by optimizing the solid core hardness profile, optimizing the relationship between the intermediate layer, cover and core surface hardnesses, and using a specific thermoplastic block copolymer together with a specific highly neutralized ionomer as the intermediate layer material, has an excellent feel on impact and an excellent spin performance on approach shots, achieves a lower spin rate on full shots, and has an improved distance. Moreover, the ball rebound and durability precision are further enhanced, and molding can be carried out at a high productivity even when forming a thin cover.

EXAMPLES

The following Examples and Comparative Examples are provided by way of illustration and not by way of limitation.

Examples 1 to 8, Comparative Examples 1 to 9

Solid cores were fabricated by preparing core compositions in the respective formulations No. 1 to No. 9 shown in Tables 1 and 2, then molding and vulcanizing under the vulcanization conditions shown in the tables.

TABLE 1

| | Type | Manufacturer | Catalyst | cis-1,4 bonds (%) | 1,2-vinyl bonds (%) | Mooney viscosity | Mw/Mn |
|---|---|---|---|---|---|---|---|
| BR | BR01 | JSR | Ni | 96 | 2.5 | 46 | 4.2 |
| | BR730 | JSR | Nd | 96 | 1.3 | 55 | 3 |

Next, an intermediate layer and a cover were formed over the solid core by injection molding, in this order, the respective resin materials shown in Table 3.

TABLE 2

| | | No. 1 | No. 2 | No. 3 | No. 4 | No. 5 | No. 6 | No. 7 | No. 8 | No. 9 |
|---|---|---|---|---|---|---|---|---|---|---|
| Core | BR01 | 100 | | 100 | 100 | | 100 | 100 | 100 | 100 |
| | BR730 | | 100 | | | 100 | | | | |
| | Perhexa C-40 | 0.6 | 3 | 0.6 | 0.6 | 0.6 | 0.6 | 0.6 | 0.6 | 0.6 |
| | Actual amount added | 0.24 | 1.2 | 0.24 | 0.24 | 0.24 | 0.24 | 0.24 | 0.24 | 0.24 |
| | Percumyl D | 0.6 | 0 | 0.6 | 0.6 | 0.6 | 0.6 | 0.6 | 0.6 | 0.6 |
| | Zinc oxide | 32.8 | 32.9 | 31.5 | 32.2 | 32.6 | 32.3 | 29.3 | 33.8 | 37 |
| | Antioxidant | 0.1 | 0.1 | 0.1 | 0.1 | 0.1 | 0.1 | 0.1 | 0.1 | 0.1 |
| | Zinc stearate | 5 | 5 | 5 | 5 | 5 | 5 | 5 | 5 | 5 |
| | Zinc acrylate | 25.5 | 27 | 29 | 27 | 26 | 28 | 27.5 | 24 | 26.5 |
| | Zinc salt of pentachlorothiophenol | 1 | 1 | 1 | 1 | 1 | 0.2 | 1 | 0.2 | 1 |
| Vulcanization conditions | Temperature (° C.) | 160 | 160 | 160 | 160 | 160 | 160 | 160 | 160 | 160 |
| | Time (min) | 13 | 13 | 13 | 13 | 13 | 13 | 13 | 13 | 13 |

Numerical values for the formulations in the table indicate parts by weight.

Figure 2:
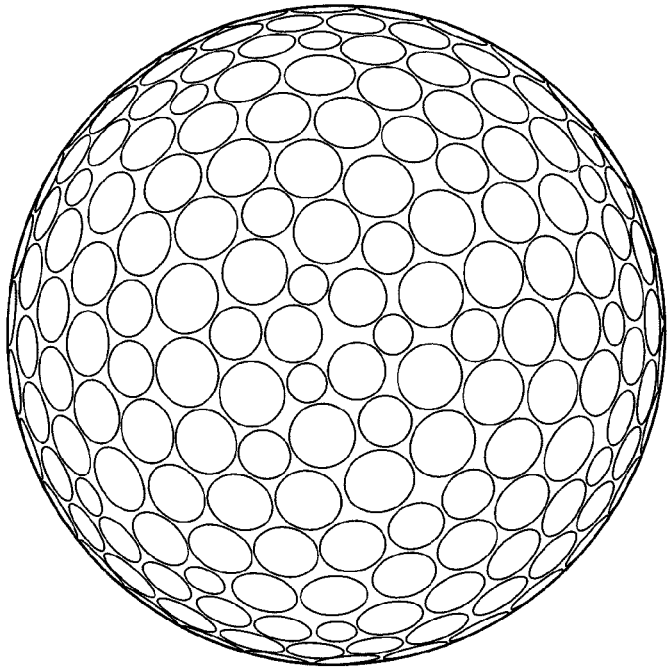
FIG. 2 is a plan view of the surface of the golf balls in the examples (Dimples I to IV).
Figure 3:
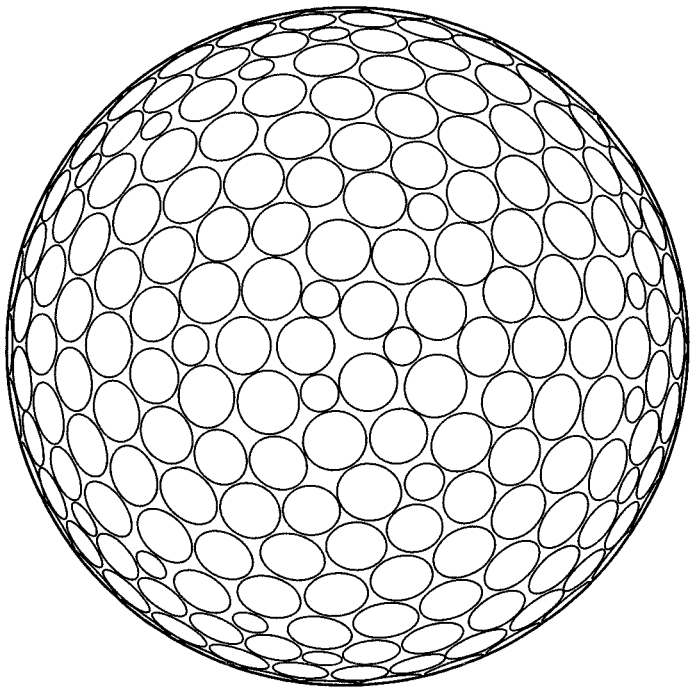
FIG. 3 is a plan view of the surface of the golf balls in the comparative examples (Dimple V).

BR01: Available from JSR Corporation; nickel catalyst
BR730: Available from JSR Corporation; neodymium catalyst
Antioxidant: Available under trade name "Nocrac NS-6" from Ouchi Shinko Chemical Industry Co., Ltd.
Zinc acrylate: Available from Nihon Jyoryu Kogyo Co., Ltd.
Perhexa C-40: Available from NOF Corporation
Percumyl D: Available from NOF Corporation Dimples A plurality of dimple types were used in combination on the golf balls of the working examples and the comparative examples. Specifically, dimple types I (336 dimples), II (336 dimples), III (336 dimples), IV (336 dimples) and V (408 dimples) were used. The respective patterns are shown in FIGS. 2 and 3. Dimple types I to IV had the same arrangements but different TVT values.

TABLE 3

| Trade name/ Substance | Type of polymer | A | B | C | D | E | a | b | c | d |
|---|---|---|---|---|---|---|---|---|---|---|
| Himilan 1605 | Binary copolymeric ionomer | | | | | | | | 50 | |
| Himilan 1706 | Binary copolymeric ionomer | | | | | | | | 50 | |
| Himilan 1601 | Binary copolymeric ionomer | | | | | 48 | 42.5 | | | |
| Himilan 1557 | Binary copolymeric ionomer | | | | | 52 | 42.5 | | | |
| Himilan 1650 | Binary copolymeric ionomer | | | | | | | | | |
| Surlyn 7930 | Binary copolymeric ionomer | | | | 30 | | | 57 | | 60 |
| Surlyn 6320 | Ternary copolymeric ionomer | | | | 55 | | | 18.5 | | 35 |
| Nucrel AN4319 | Ethylene-methacrylic acid-acrylic acid ester random terpolymer | 84 | 70 | 100 | | | | | | |
| Nucrel AN4318 | Same as above | | | | 14.5 | | 15 | 24.5 | | 5 |
| Nucrel 1560 | Ethylene-methacrylic acid random copolymer | 1 | 15 | | | | | | | |
| Dynaron 6100P | Thermoplastic block copolymer having crystalline polyolefin block and polyethylene/butylene random copolymer | 15 | 15 | | | | | | | |
| Magnesium stearate | | 59 | 59 | 69 | 0.6 | 0.6 | | 1 | | |
| Magnesium oxide | | 1 | 1 | 1.2 | | | | | | |
| Titanium dioxide | | | | | | | 4.8 | 4 | 4.8 | 4.8 |
| Polyethylene wax | | | | | | | | | 2 | |
| Thermoplastic elastomer | | | | | | | | | 2 | |
| Shore D hardness | | 48 | 51 | 51 | 48 | 60 | 57 | 53 | 62 | 57 |
| MFR (g/10 min) | | 13.5 | 15 | 11 | 3.3 | 2.2 | 5 | 5 | 1.3 | 1.9 |

Numerical values for the formulations in the table indicate parts by weight.

Himilan: Ionomer resins available from DuPont-Mitsui Polychemicals Co., Ltd.

Surlyn: Ionomer resins available from E.I. DuPont de Nemours and Co.

The following ball properties were measured in the resulting golf balls. In addition, flight tests were carried out by the method described below, and the spin rate on approach shots, feel on impact, and durability to consecutive impact were evaluated. The results are given in Tables 4 and 5.

Deflection on Loading from 10 kg to 130 kg

Using a model 4204 test system manufactured by Instron Corporation, the ball was compressed at a rate of 10 mm/min, and the difference between the deflection under a load of 10 kg and the deflection under a load of 130 kg was measured.

Cross-Sectional Hardness

The core was cut with a fine cutter, and the Shore D hardnesses at the center of the cross-section and at regions 5 mm, 10 mm and 15 mm from the center of the cross-section were measured.

Surface Hardness

The Shore D hardnesses at the surface of the core and at the surface of the finished product were measured.

Measurements of the cross-sectional and surface hardnesses were carried out at two places each on N=5 specimens. The Shore D hardnesses were values measured in accordance with ASTM D-2240 after temperature conditioning at 23° C.

Melt Flow Rate (MFR)

The melt flow rate was measured in accordance with JIS-K6760 (test temperature, 190° C.; test load, 21 N (2.16 kgf)).

Flight Performance

Each ball was struck ten times at a head speed (HS) of 45 m/s with the Tour Stage X-Drive (loft angle, 10.5°) driver (manufactured by Bridgestone Sports Co., Ltd.) mounted on a golf swing robot, and the spin rate (rpm) and total distance (m) were measured. The variability was rated based on the total left-right variation and the variation in distance.

Spin on Approach Shots

The spin rate (rpm) of the ball when struck at a head speed (HS) of 20 m/s with the Tour Stage X-Wedge (loft angle, 58°) sand wedge (SW) (manufactured by Bridgestone Sports Co., Ltd.) mounted on a golf swing robot was measured.

Feel

Three top amateur golfers rated the feel of the balls according to the following criteria when struck with a driver (W#1) at a head speed (HS) of 40 to 45 m/s, and when hit a distance of 5 to 10 m with a putter (#PT).

Good: Good feel

Fair: Somewhat hard or somewhat soft

NG: Too hard or too soft

Durability to Cracking

The ball was repeatedly fired against a steel plate wall at an incident velocity of 43 m/s, and the number of shots taken until the ball cracked was determined. The values shown are averages for N=5 specimens.

Sphericity

The sphericity was obtained by measuring the diameter of a single ball at 15 random points on the ball, and determining the difference between the largest value and the smallest value (largest value-smallest value) in millimeters (unit: mm).

The ten balls were measured by the above method and its average value was given.

TABLE 4

| | | | Example | | | | | | | |
|---|---|---|---|---|---|---|---|---|---|---|
| | | | 1 | 2 | 3 | 4 | 5 | 6 | 7 | 8 |
| Core | Type | | No. 1 | No. 2 | No. 3 | No. 4 | No. 4 | No. 4 | No. 4 | No. 5 |
| | Diameter (mm) | | 36.1 | 36.1 | 36.1 | 36.1 | 36.1 | 36.1 | 36.1 | 36.1 |
| | Deflection on 10-130 kg loading (mm) | | 4.5 | 4.2 | 3.8 | 4.2 | 4.2 | 4.2 | 4.2 | 4.2 |
| | Center hardness (Shore D) | | 32 | 32 | 36 | 34 | 34 | 34 | 34 | 34 |
| | Hardness 5 mm from center (Shore D) | | 33 | 36 | 38 | 35 | 35 | 35 | 35 | 35 |
| | Hardness 10 mm from center (Shore D) | | 35 | 36 | 41 | 38 | 38 | 38 | 38 | 38 |
| | Hardness 15 mm from center (Shore D) | | 37 | 46 | 43 | 40 | 40 | 40 | 40 | 40 |
| | Surface hardness (Shore D) | | 39 | 51 | 45 | 42 | 42 | 42 | 42 | 42 |
| | Hardness difference between core center and surface (Shore D) | | 7 | 19 | 9 | 8 | 8 | 8 | 8 | 8 |
| Intermediate layer | Type | | A | A | A | A | A | A | B | A |
| | Hardness (Shore D) | | 48 | 48 | 48 | 48 | 48 | 48 | 51 | 48 |
| | MFR | | 13.5 | 13.5 | 13.5 | 13.5 | 13.5 | 13.5 | 15 | 13.5 |
| | Hardness difference between intermediate layer and core surface (Shore D) | | 9 | −3 | 3 | 6 | 6 | 6 | 9 | 6 |
| | Thickness (mm) | | 1.95 | 1.95 | 1.95 | 1.95 | 1.95 | 1.95 | 1.95 | 1.95 |
| Cover | Type | | a | a | a | a | a | a | a | b |
| | Hardness (Shore D) | | 57 | 57 | 57 | 57 | 57 | 57 | 57 | 53 |
| | MFR | | 5 | 5 | 5 | 5 | 5 | 5 | 5 | 5 |
| | Hardness difference between cover and intermediate layer (Shore D) | | 9 | 9 | 9 | 9 | 9 | 9 | 6 | 5 |
| | Thickness (mm) | | 1.35 | 1.35 | 1.35 | 1.35 | 1.35 | 1.35 | 1.35 | 1.35 |
| | Combined thickness of cover + intermediate layer (mm) | | 3.3 | 3.3 | 3.3 | 3.3 | 3.3 | 3.3 | 3.3 | 3.3 |
| Product | Deflection on 10-130 kg loading (mm) | | 3.6 | 3.1 | 3 | 3.3 | 3.3 | 3.3 | 3.2 | 3.4 |
| | Diameter (mm) | | 42.7 | 42.7 | 42.7 | 42.7 | 42.7 | 42.7 | 42.7 | 42.7 |
| | Sphericity (mm) | | 0.1 | 0.1 | 0.1 | 0.1 | 0.1 | 0.1 | 0.1 | 0.1 |
| Dimples | Type | | I | I | I | I | II | III | I | I |
| | Number of dimples | | 336 | 336 | 336 | 336 | 336 | 336 | 336 | 336 |
| | TVT | | 675 | 675 | 675 | 675 | 702 | 643 | 675 | 675 |
| Distance | HS 45, driver | Spin rate (rpm) | 2590 | 2600 | 2730 | 2660 | 2650 | 2670 | 2610 | 2700 |
| | | Total (m) | 228.5 | 230.0 | 229.5 | 229.0 | 229.5 | 228.5 | 230.0 | 228.0 |
| | | Variability | good | good | good | good | good | good | good | good |
| Approach shots | HS 20 | Spin rate (rpm) | 5350 | 5400 | 5590 | 5470 | 5480 | 5460 | 5430 | 5550 |
| Initial velocity | (m/s) | | 77.3 | 77.4 | 77.5 | 77.4 | 77.4 | 77.4 | 77.5 | 77.2 |
| Durability | Durability to cracking (incident velocity, 43 m/s), shots | | 303 | 339 | 518 | 408 | 404 | 413 | 368 | 464 |
| Feel | Driver | | good | good | fair | good | good | good | good | good |
| | Putter | | good | good | fair | good | good | good | fair | good |

TABLE 5

| | | Comparative Example | | | | | | | | |
|---|---|---|---|---|---|---|---|---|---|---|
| | | 1 | 2 | 3 | 4 | 5 | 6 | 7 | 8 | 9 |
| Core | Type | No. 6 | No. 7 | No. 4 | No. 4 | No. 4 | No. 8 | No. 4 | No. 9 | No. 4 |
| | Diameter (mm) | 36.1 | 36.8 | 36.1 | 36.1 | 36.1 | 36.1 | 36.1 | 35 | 36.1 |
| | Deflection on 10-130 kg loading (mm) | 3.3 | 4.2 | 4.2 | 4.2 | 4.2 | 4.2 | 4.2 | 4.2 | 4.2 |
| | Center hardness (Shore D) | 39 | 34 | 34 | 34 | 34 | 34 | 34 | 34 | 34 |
| | Hardness 5 mm from center (Shore D) | 42 | 35 | 35 | 35 | 35 | 35 | 35 | 35 | 35 |
| | Hardness 10 mm from center (Shore D) | 44 | 38 | 38 | 38 | 38 | 38 | 38 | 38 | 38 |
| | Hardness 15 mm from center (Shore D) | 47 | 40 | 40 | 40 | 40 | 40 | 40 | 40 | 40 |

TABLE 5-continued

| | | | Comparative Example | | | | | | | | |
|---|---|---|---|---|---|---|---|---|---|---|---|
| | | | 1 | 2 | 3 | 4 | 5 | 6 | 7 | 8 | 9 |
| | Surface hardness (Shore D) | | 50 | 42 | 42 | 42 | 42 | 42 | 42 | 42 | 42 |
| | Hardness difference between core center and surface (Shore D) | | 11 | 8 | 8 | 8 | 8 | 8 | 8 | 8 | 8 |
| Intermediate layer | Type | | A | C | D | A | A | A | A | A | E |
| | Hardness (Shore D) | | 48 | 51 | 48 | 48 | 48 | 48 | 48 | 48 | 60 |
| | MFR | | 13.5 | 11 | 3.3 | 13.5 | 13.5 | 13.5 | 13.5 | 13.5 | 2.2 |
| | Hardness difference between intermediate layer and core surface (Shore D) | | −2 | 9 | 6 | 6 | 6 | 6 | 6 | 6 | 18 |
| | Thickness (mm) | | 1.95 | 1.6 | 1.95 | 1.95 | 1.95 | 1.95 | 1.95 | 2.3 | 1.95 |
| Cover | Type | | a | a | a | a | a | c | d | a | a |
| | Hardness (Shore D) | | 57 | 57 | 57 | 57 | 57 | 62 | 57 | 57 | 57 |
| | MFR | | 5 | 5 | 5 | 5 | 5 | 1.3 | 1 | 5 | 5 |
| | Hardness difference between cover and intermediate layer (Shore D) | | 9 | 6 | 9 | 9 | 9 | 14 | 9 | 9 | −3 |
| | Thickness (mm) | | 1.35 | 1.35 | 1.35 | 1.35 | 1.35 | 1.35 | 1.35 | 1.55 | 1.35 |
| | Combined thickness of cover + intermediate layer (mm) | | 3.3 | 2.95 | 3.3 | 3.3 | 3.3 | 3.3 | 3.3 | 3.85 | 3.3 |
| Product | Deflection on 10-130 kg loading (mm) | | 2.5 | 3.2 | 3.3 | 3.3 | 3.3 | 3.1 | 3.3 | 2.9 | 2.8 |
| | Diameter (mm) | | 42.7 | 42.7 | 42.7 | 42.7 | 42.7 | 42.7 | 42.7 | 42.7 | 42.7 |
| | Sphericity (mm) | | 0.1 | 0.1 | 0.1 | 0.1 | 0.1 | 0.1 | 0.3 | 0.1 | 0.1 |
| Dimples | Type | | I | I | I | IV | V | I | I | I | I |
| | Number of dimples | | 336 | 336 | 336 | 336 | 408 | 336 | 336 | 336 | 336 |
| | TVT | | 675 | 675 | 675 | 610 | 634 | 675 | 675 | 675 | 675 |
| Distance | HS 45, driver | Spin rate (rpm) | 2870 | 2640 | 2690 | 2670 | 2670 | 2610 | 2660 | 2700 | 2430 |
| | | Total (m) | 228.0 | 229.0 | 226.0 | 226.0 | 227.0 | 230.0 | 228.5 | 225.5 | 230.0 |
| | | Variability | good | good | good | good | good | good | large, poor | good | good |
| Approach shots | HS 20 | Spin rate (rpm) | 5690 | 5450 | 5450 | 5460 | 5460 | 5220 | 5450 | 5430 | 5280 |
| Initial velocity | (m/s) | | 77.6 | 77.5 | 76.9 | 77.4 | 77.4 | 77.5 | 77.4 | 76.8 | 77.4 |
| Durability | Durability to cracking (incident velocity, 43 m/s), shots | | 636 | 260 | 441 | 401 | 405 | 288 | 285 | 539 | 306 |
| Feel | Driver | | NG | good | good | good | good | fair | good | NG | fair |
| | Putter | | fair | fair | good | good | good | NG | good | NG | NG |

In Comparative Example 1, the finished ball was too hard. As a result, the ball had a hard feel, the spin rate was excessive, and the distance decreased.

In Comparative Example 2, the intermediate layer material was composed only of a highly neutralized material. As a result, the ball had a poor durability.

In Comparative Example 3, the intermediate layer material was made of an ordinary ionomer. As a result, the ball had a low rebound and a reduced distance.

In Comparative Example 4, the ball trajectory was low, making it impossible to achieve the desired carry and resulting in a decreased distance.

In Comparative Example 5, the number of dimples was large, and the coefficient of drag was high, resulting in a decrease in the distance traveled by the ball.

In Comparative Example 6, the cover was hard. As a result, the ball had a low spin rate and a poor controllability. In addition, the ball had a hard feel and a decreased durability to cracking.

In Comparative Example 7, the cover had a low melt flow rate (MFR), resulting in a poor cover sphericity. The variability in flight was also large.

In Comparative Example 8, the intermediate layer and cover were thick. As a result, the ball had a low rebound and a poor distance. In addition, the ball had a hard feel.

In Comparative Example 9, the intermediate layer was hard. As a result, the ball had a low spin rate on approach shots and had a hard feel on shots with a putter.

The invention claimed is:

1. A multi-piece solid golf ball comprising a solid core, a cover, at least one intermediate layer interposed therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to a region 10 mm from the core center of from 23 to 41, a Shore D hardness in a region 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random terpolymer and/or a metal salt thereof, (b) from 1 to 8 wt % of an olefin-unsaturated carboxylic acid random copolymer, and (c) from 5 to 50 wt % of a thermoplastic block copolymer having a crystalline polyolefin block and a polyethylene/butylene random copolymer, with (d) from 5 to 100 parts by weight of a fatty acid or fatty acid derivative having a molecular weight of from 280 to 1500, and (e) from 0.1 to 10 parts by weight of a basic inorganic metal compound capable of neutralizing acid groups within components (a), (b) and (d);

the intermediate layer has a thickness of from 1.5 to 2.5 mm; the intermediate layer material has a Shore D hardness of from 35 to 55 and a melt flow rate (MFR) of from 9 to 30 g/10 min; the intermediate layer has a Shore D hardness difference with the surface of the solid core of within ±10; the cover is composed primarily of a thermoplastic resin, has a thickness of from 0.5 to 1.5 mm, and has a Shore D hardness of from 50 to 59 which is higher than the intermediate layer hardness, the Shore D hardness difference therebetween being from 1 to 15; the cover has a material melt flow rate (MFR) of from 2 to 30 g/10 min; the cover and the intermediate layer have a combined thickness of from 2 to 3.5 mm; the overall ball has a deflection, when compressed under a final load of 130 kgf from an initial load of 10 kgf, of from 2.9 to 5.0 mm; the number of dimples is from 250 to 400; and the sum of the dimple trajectory volumes VT (total dimple trajectory volume TVT) obtained by multiplying the volume of each dimple by the square root of the dimple diameter is from 640 to 800.

2. The multi-piece solid golf ball of claim 1, wherein the thermoplastic resin of the cover is a thermoplastic ionomer.

3. A multi-piece solid golf ball comprising a solid core, a cover, at least one intermediate layer interposed therebetween, and a plurality of dimples on a surface of the ball, wherein the solid core has a diameter of from 34 to 38.7 mm, a deflection when compressed under a final load of 130 kgf from an initial load of 10 kgf of from 3.5 to 6.0 mm, a Shore D hardness at a center of the core of from 20 to 38, a Shore D hardness in a region 5 mm to a region 10 mm from the core center of from 23 to 41, a Shore D hardness in a region 15 mm from the core center of from 28 to 46, and a Shore D hardness at a surface of the core of from 37 to 62; the intermediate layer is composed primarily of a material obtained by mixing under applied heat:

100 parts by weight of a resin component of (a) from 95 to 50 wt % of an olefin-unsaturated carboxylic acid-unsaturated carboxylic acid ester random terpolymer and/or a metal salt thereof, (b) from 1 to 8 wt % of an olefin-unsaturated carboxylic acid random copolymer and/or a metal salt thereof, and (c) from 5 to 50 wt % of a thermoplastic block copolymer having a crystalline polyolefin block and a polyethylene/butylene random copolymer, with (d) from 5 to 100 parts by weight of a fatty acid or fatty acid derivative having a molecular weight of from 280 to 1500, and (e) from 0.1 to 10 parts by weight of a basic inorganic metal compound capable of neutralizing acid groups within components (a), (b) and (d);

the intermediate layer has a thickness of from 1.5 to 2.5 mm; the intermediate layer material has a Shore D hardness of from 35 to 55 and a melt flow rate (MFR) of from 9 to 30 g/10 min; the intermediate layer has a Shore D hardness difference with the surface of the solid core of within ±10; the cover is composed primarily of a thermoplastic resin, has a thickness of from 0.5 to 1.5 mm, and has a Shore D hardness of from 50 to 59 which is higher than the intermediate layer hardness, the Shore D hardness difference therebetween being from 6 to 15; the cover has a material melt flow rate (MFR) of from 2 to 30 g/10 min; the cover and the intermediate layer have a combined thickness of from 2 to 3.5 mm; the overall ball has a deflection, when compressed under a final load of 130 kgf from an initial load of 10 kgf, of from 2.9 to 5.0 mm; the number of dimples is from 250 to 400; and the sum of the dimple trajectory volumes VT (total dimple trajectory volume TVT) obtained by multiplying the volume of each dimple by the square root of the dimple diameter is from 640 to 800.

4. The multi-piece solid golf ball of claim 3, wherein the thermoplastic resin of the cover is a thermoplastic ionomer.

5. The multi-piece solid golf ball of claim 1, wherein the olefin-unsaturated carboxylic acid-unsaturated carboxylic acid ester random terpolymer and/or a metal salt thereof serving as component (a) has a weight-average molecular weight (Mw) of from 100,000 to 200,000 and a weight-average molecular weight (Mw) to number-average molecular weight (Mn) ratio of from 3.0 to 7.0.

6. The multi-piece solid golf ball of claim 1, wherein the olefin-unsaturated carboxylic acid random copolymer serving as component (b) has a weight-average molecular weight (Mw) of from 100,000 to 200,000 and a weight-average molecular weight (Mw) to number-average molecular weight (Mn) ratio of from 3.0 to 7.0.

7. The multi-piece solid golf ball of claim 3, wherein the olefin-unsaturated carboxylic acid-unsaturated carboxylic acid ester random terpolymer and/or a metal salt thereof serving as component (a) has a weight-average molecular weight (Mw) of from 100,000 to 200,000 and a weight-average molecular weight (Mw) to number-average molecular weight (Mn) ratio of from 3.0 to 7.0.

8. The multi-piece solid golf ball of claim 3, wherein the olefin-unsaturated carboxylic acid random copolymer and/or metal salt thereof serving as component (b) has a weight-average molecular weight (Mw) of from 100,000 to 200,000 and a weight-average molecular weight (Mw) to number-average molecular weight (Mn) ratio of from 3.0 to 7.0.

* * * * *